United States Patent [19]

Lee

[11] 4,212,232

[45] Jul. 15, 1980

[54] METHOD OF PRODUCING A FOLDABLE CONTAINER

[76] Inventor: Gee Y. Lee, 62, Kochok-Dong, Youngdeungpo-ku, Seoul, Rep. of Korea

[21] Appl. No.: 964,206

[22] Filed: Nov. 28, 1978

[51] Int. Cl.[2] ..... B31B 5/26

[52] U.S. Cl. ..... 93/49 M; 93/36.8; 93/86

[58] Field of Search ..... 229/4.5, 5.5, 1.5 R, 229/1.5 B; 128/DIG. 24; 93/49 M, 49 R, 36.8, 86, 9

[56] References Cited

U.S. PATENT DOCUMENTS

| | | | |
|---|---|---|---|
| 979,629 | 12/1910 | Wright | 229/1.5 B |
| 1,127,480 | 2/1915 | Maxwell | 229/1.5 B |
| 1,632,868 | 6/1927 | Barbieri | 229/1.5 B |
| 1,810,806 | 6/1931 | Wilson | 229/1.5 B |
| 3,924,795 | 12/1975 | Smith | 229/4.5 |
| 3,973,693 | 8/1976 | Brocklehurst | 220/66 |

*Primary Examiner*—James F. Coan

*Attorney, Agent, or Firm*—Fleit & Jacobson

[57] ABSTRACT

A container for soluble, dehydrated foodstuffs is produced which may be folded flatly. The container is initially conically shaped and the apex of the cone is inverted and caused to protrude into the inner volume of the container, whereby the bottom surface of the container is a circumferentially flat ring for stable placement on flat surfaces. The inner protruding cone is provided with markings indicating the amount of liquid to be added to the foodstuffs to produce the desired end product.

2 Claims, 9 Drawing Figures

FIG. 3
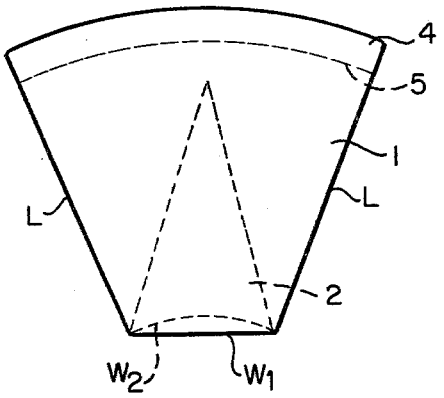
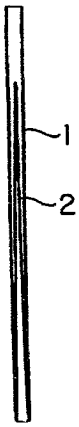
FIG. 4a
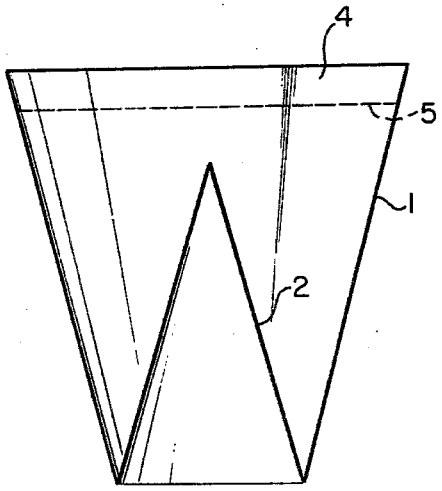
FIG. 4b

FIG. 4c
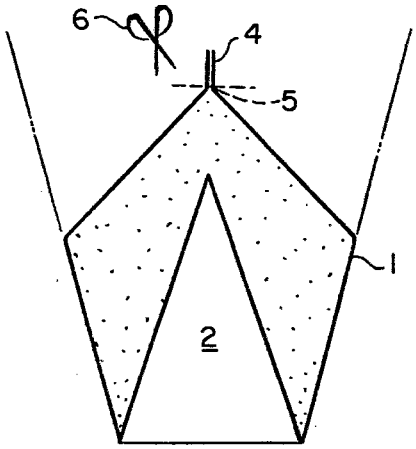
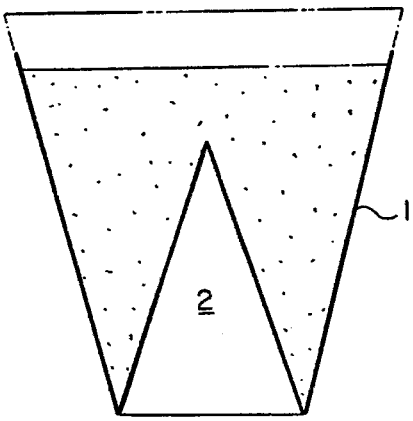
FIG. 4d

METHOD OF PRODUCING A FOLDABLE CONTAINER

BACKGROUND OF THE INVENTION

The present invention relates to foldable dehydrated food containers. More specifically, it relates to a method for producing a container which may be folded flatly and then unfolded to a final form which is void of unsightly wrinkles and has a planar bottom which may be placed in a stable fashion on a flat surface.

Recently, many instant (dehydrated) foods, such as powdered juice, milk, cream, jam, and other foods in the state of powder or liquid, as well as gel-state instant foods, have been developed. These instant foods are packaged commonly not in a large quantity but in a small quantity to provide a single individual portion. Because the package quite possibly will be dispensed by an automatic system, it is required that the volume of the folded containers must be rather reduced to give the convenience in the carriage, treatment and management of the containers. Also the container should give safety in use after the container is filled, i.e., it should not tip or spill easily. Additionally, the container must be both inexpensive in its materials and also easy to manufacture. However, until now, there is no container that satisfies the expansion of the container, the flatness of the bottom of the container, and easy manufacture.

At present, if the container is made of paper, thin plastic sheet, or a cloth paper coated with aluminium, it is possible to obtain a container having a flat bottom, because such material can be folded or expanded. However, even when the container is made of such material the circumference forming the bottom of the container cannot be folded or deformed. This is so because the contact between the circumference along the bottom and the side wall(s) of the container has no change, hence, when the circumference is compressed, there appears a lot of wrinkles and scars along the location where the circumference of the bottom and the side wall of the container are joined. Thus, when the container is expanded to store the foods, the container cannot provide good expansion because such container cannot be returned to its original state before expansion. It is a known fact that, according to geometrical theory, a smooth circumference between the bottom and side wall cannot be obtained in a compressed state.

SUMMARY OF THE INVENTION

The present invention relates to a method for producing a container that, by uplifting the lower conical portion to the inner part of the container, the apex of the cone is caused to protrude into the container.

The purpose of the present invention is to produce a container that is folded flatly in a certain dimension and can package foods such as powdered juice, milk, or another instant food, by expanding the folded container.

The meaning of the term "folded flatly" in the present specification is that the container can be folded naturally along the folding lines, without adding any unreasonable wrinkles and/or scars to the circumference of the container, similar to the way an envelope is folded. The meaning of the phrase "expanding the folded container" is that the folded container is expanded to the shape of a cup, wherein the upper part is wide and the lower part is narrow so that, because the bottom of the container forms a planar circle along the circumference, the container can be placed safely on a flat plane.

The characteristic feature of the present invention is that in a cone, similar to a common ice cream container, the conical shape has no base side; hence, by protruding or projecting the apex of the cone into the inside of the container, the container will have planar circumference along the line where the conical portion protrudes into the inner part of container. Namely, according to the presentinvention, by inserting the conical apex into the inner part of the container, a specific new style container is developed.

According to the present invention, because the container has no base side and the longitudinal section is terminated at the apex of the cone, the circumference of the container may be folded flatly, and there appears no wrinkles and/or scars on the walls of the container. Additionally, the container can be easily folded along the main folding line and also kept in a thin volume and supplied to the automatic packaging machine. As the folded conical part which protrudes into the inner part of the container is unfolded, a small cone appears in the inner part of the container and the container thereby forms essentially a cup-like shape which contains the dehydrated foodstuffs.

When the container is used to store powdered juice, for example, the powdered juice in a sufficient amount is packaged and, then, the container is folded flatly. When a person desires to drink the juice, he must only expand the container and pour water into the container. Because the container forms a cup-like shape when it is expanded, the person can use the container safely. Additionally, the conical portion which protrudes into the inner part of the container may be provided with marks or the like forming a scale. In this manner the person can control the amount of water to be poured into the container.

Therefore, it is an object of the present invention to provide a container which may be folded flatly and which may be expanded forming a cup which may rest on a flat surface and which is not wrinkled along the fold lines.

It is another object of the present invention to provide a dehydrated food container which has an integrally formed indicator for indicating the amount of liquid added to the container.

It is still another object to provide a foldable dehydrated foodstuffs container which may be folded flatly and unfolded into a truncated cone-shaped cup having a planar bottom.

It is a further object of the present invention to provide a method of making a foldable container.

The manner in which these and other objects are accomplished by the present invention will become apparent from the following detailed description of a preferred embodiment.

BRIEF DESCRIPTION OF THE DRAWINGS

FIG. 3 is a side elevation of the container of the present invention folded;

FIG. 4*a* shows the folded state of container of the present invention, before the container is unfolded;

FIG. 4*b* shows the unfolded state of the container of the present invention, ready for use;

FIG. 4*c* shows how the container of the present invention is packed and opened, FIG. 4*d* shows the opened state of the container of the present invention;

DETAILED DESCRIPTION OF THE INVENTION

Figure 1:
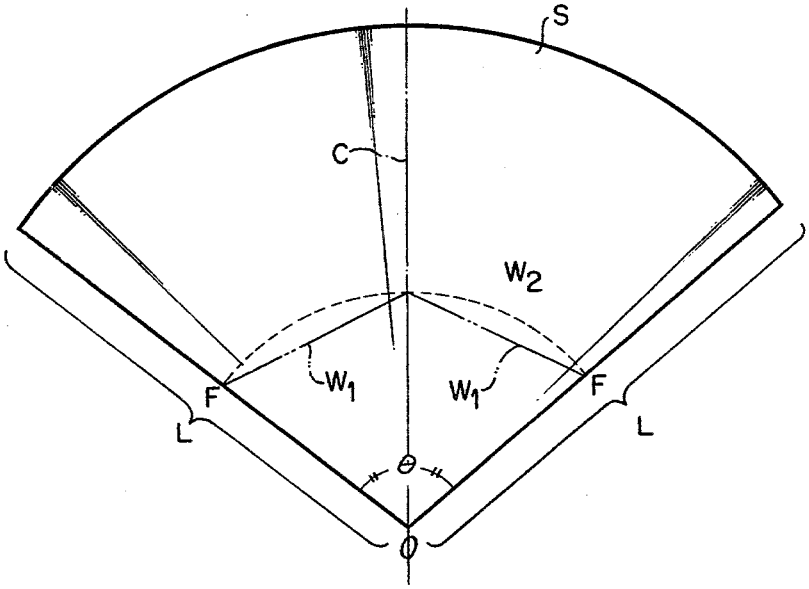
FIG. 1 is a development diagram of the container of the present invention.

Referring now to FIG. 1, a development diagram of the present invention is shown. The inventive folding cup may be formed of any common material that has the nature to be folded or unfolded, such as waterproof paper, soft plastic, cloth, or any other sheet material coated with aluminium. The fan-shaped container-forming material S is formed having a central angle $\theta$ at the center point O. The length of side line L is determined solely by the size of the cup which is required.

From the points F,F located along the side lines L, the line $W_1$—$W_1$ is linked with the point O' located on the center line C. With the point O as a center, an arc having the radius equivalent to the length of O-F is described. This forms arc $W_2$. The material S is then folded along the arc $W_2$, to obtain the container of present invention.

In order to produce the container of the present invention, the fan-shaped container-forming material S is folded in half on its center line and along the lines $W_1$-O-$W_1$ and both sides of the side line L are connected. The container 1 is formed by having the apex 2 of the cone protrude into the inner part of the container. Scale marks 3 are placed on the conical portion which will protrude into the container and cutting line 5 is placed along the upper adhering area 4. This completes the container of the present invention.

While it is possible to produce the container of present invention from a two-dimensional developed sheet by the method as explained above, it may also be possible to form it as a three-dimensional object by a plastic molding process. There are no limitations placed on the size of container which may be formed.

As seen in FIG. 3, because the container produced by the present invention has no base element and the longitudinal section is terminated at the apex O of the cone 2, the sides of the container 1 will be folded flatly along the side line L and the bottom circumference is folded along the line $W_1$. In this manner the container will have no wrinkles and/or scars, as illustrated in the FIGS. 2 and 4-(*a*). It is notable that the container of the present invention has easiness in the carriage, treatment and/or management before and after the package is formed. Moreover, this shape is simple to supply automatically to and from an automatic packaging machine.

Figure 2:
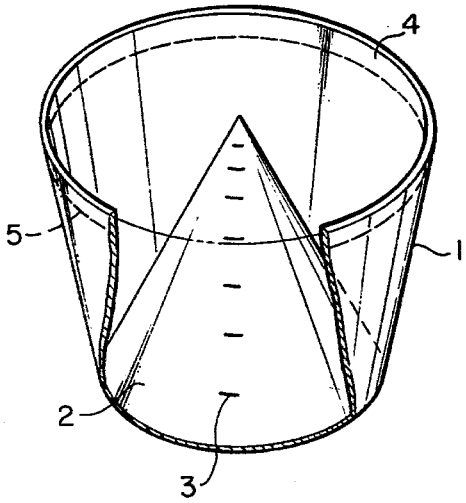
FIG. 2 is a perspective showing the container of the present invention unfolded.

When the portion 2 that protrudes into the inner part of the container 1 is expanded into a conical portion (e.g. by inserting fingers into it), the bottom of the container 1 is unfolded along the arc $W_2$ from the folded line $W_1$ and the container is expanded to a cup-like shape, as illustrated in FIG. 2. After the container is filled with the foods, an upper area 4 is adhered so that the package of the container is completed. That is, the folded, food-containing package is sealed by adhesive or crimping at 5.

In case powdered juice and/or other foods having a small volume are packaged, the container is folded flatly after it is filled. Thus, when a person is going to consume the foods in the container, the person cuts the upper adhering area 4 with scissors 6 or the like and opens the mouth of the container 1. The container 1 can be returned to a cup-like shape as illustrated in the FIG. 4-(*d*) and, by adding the water along the mark on the scale 3 marked on the cone 2 protruding into the container, the person can prepare and consume the foods in the container. Since the container forms a round planar bottom as the container is expanded, it is possible to place the container safely on a flat surface.

Because the container of present invention is formed in a cup-like shape as the container is opened, there is no need to use another cup to drink the foods in the container so that the container of present invention can be used more effectively than any prior ones.

FIG. 4*c* shows diagramatically a filled and folded container being opened by cutting with scissors 6 or the like along the adhesion line 5.

Figure 5A:
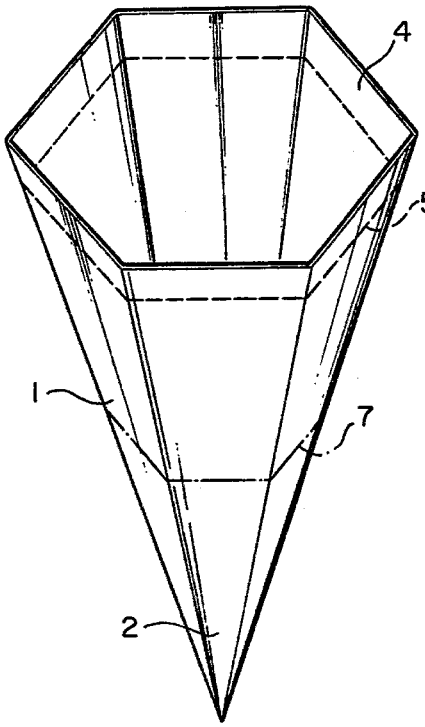
FIG. 5*a* is a perspective of the present invention in the form of a hexagonal pyramid.
Figure 5B:
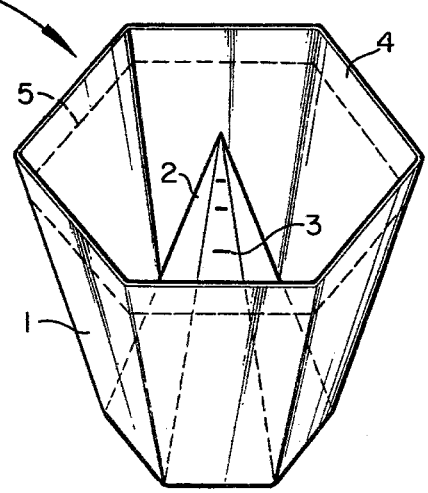
FIG. 5*b* is a perspective of the embodiment of FIG. 5*a* folded into a cup-like shape.

FIGS. 5*a* and 5*b* show another embodiment of the inventive container in the form of a hexagonal pyramid. Although this container is formed with six sides, any number of sides may be utilized, but, an even number of sides is preferred. As may be seen, the container is initially formed as a pyramid and then folded along line 7 so that the apex of the pyramid is caused to protrude into the inner portion of the container. This container may be folded flat along the side lines 7 and then utilized exactly as the conical embodiment described above.

The above description of the present invention is presented by way of example only and is not intended to limit the scope of the present invention, except as set forth in the claims hereinafter.

I claim:

1. A method of producing a container capable of being folded flatly and having a planar bottom, comprising the steps of:

forming a sheet of foldable material into a fan shape, folding said fan-shaped sheet along its center line, folding the apex of the folded fan-shaped sheet against the body of the sheet along a line from the edge of the folded fan shaped-sheet to the center line thereof, located a preselected distance from the apex of said fan-shaped sheet, unfolding said sheet, marking an arc on said sheet having its center at the apex and having a radius equal to said preselected distance, forming said sheet of foldable material into a truncated cone having the apex portion of said cone protruding into the interior of said truncated cone, and folding said truncated cone substantially flat.

2. The method of claim 1, including the further step of placing volume indicator marks on the apex portion of said truncated cone.

* * * * *